US006774567B2

(12) United States Patent
Jang et al.

(10) Patent No.: US 6,774,567 B2
(45) Date of Patent: Aug. 10, 2004

(54) MICROWAVE OVEN

(75) Inventors: Seong-Deog Jang, Suwon (KR); Dae-Sung Han, Hwasung (KR); Yong-Woon Han, Kunpo (KR); Han-Seong Kang, Suwon (KR); Kwang-Seok Kang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 49 days.

(21) Appl. No.: 10/188,894

(22) Filed: Jul. 5, 2002

(65) Prior Publication Data

US 2003/0117092 A1 Jun. 26, 2003

(30) Foreign Application Priority Data

Dec. 24, 2001 (KR) ..... 2001-0084396

(51) Int. Cl.[7] ..... H01J 25/50; H05B 6/66

(52) U.S. Cl. ..... 315/39.51; 219/715; 219/717; 219/738

(58) Field of Search ..... 315/39.51, 39.53, 315/500, 502, 503; 219/715, 717, 725, 738, 736, 729, 678, 702

(56) References Cited

U.S. PATENT DOCUMENTS

| | | | | | |
|---|---|---|---|---|---|
| 4,163,175 | A | | 7/1979 | Tashiro | 315/39.51 |
| 4,223,245 | A | * | 9/1980 | Ogura et al. | 315/39.51 |
| 5,012,058 | A | * | 4/1991 | Smith | 219/716 |
| 5,184,045 | A | | 2/1993 | Im | 315/39.51 |
| 5,300,744 | A | * | 4/1994 | Maehara et al. | 219/687 |
| 5,321,235 | A | * | 6/1994 | Makino et al. | 219/716 |
| 5,331,128 | A | * | 7/1994 | Koh | 219/717 |
| 6,362,463 | B1 | * | 3/2002 | Bessyo et al. | 219/715 |
| 6,449,178 | B1 | * | 9/2002 | Sakai et al. | 363/131 |

* cited by examiner

*Primary Examiner*—Tuyet T. Vo
(74) *Attorney, Agent, or Firm*—Staas & Halsey LLP

(57) ABSTRACT

A microwave oven using DC power which can endure strong vibrations and eliminate noise according to noise standards. The microwave oven includes at least one second choke coil which is arranged outside a magnetron filter box and connected in series to at least one first choke coil installed in the magnetron filter box. Each choke coil and a feed-through condenser constitute a low pass filter. The size of each of the first choke coil is reduced and the size of each of the second choke coil is increased, so as to endure the strong vibrations and eliminate the noise generated by a driving of a magnetron.

25 Claims, 3 Drawing Sheets

MICROWAVE OVEN

CROSS-REFERENCE TO RELATED APPLICATIONS

This application claims the benefit of Korean Application No. 2001-84396, filed Dec. 24, 2001, in the Korean Industrial Property Office, the disclosure of which is incorporated herein by reference.

BACKGROUND OF THE INVENTION

1. Field of the Invention

The present invention relates to microwave ovens, and more particularly, to a microwave oven which eliminates noise to a satisfactory standard while enduring strong vibrations.

2. Description of the Related Art

Generally, a microwave oven carries out a cooking operation by receiving an alternating current (AC) voltage from a commercial AC power source, converting it into a high voltage, and driving a magnetron using the high voltage to generate microwaves to irradiate and cook foods.

Recently, a microwave oven has been developed to use a direct current (DC) power, such as a battery, as operating power, so as to install the microwave oven in mobile vehicles, such as cars or passenger ships.

The microwave oven using the DC power employs an inverter circuit to convert a DC voltage into an AC voltage required to drive a magnetron.

FIG. 1 shows a conventional microwave oven using DC power comprising a DC power source 1, such as a portable battery, a switching unit 2, an inverter unit 3, a high voltage transformer 4, a magnetron driving unit 5 and a magnetron filter box 6. The magnetron filter box 6 includes choke coils 8 and a feed-through condenser 9 installed therein, which constitute a low pass filter, so as to prevent fundamental waves of 2450 MHz, harmonic waves and noise generated by the driving of the magnetron 7, from radiating to the outside.

Ferrite cores (not shown) are inserted into the choke coils 8, and ends of the coils 8 wound around the ferrite cores are fixed through a welding process. Typically, a large inductance of the choke coils 8 favors reduction of noise, so the choke coils 8 are designed to be as large as possible.

However, vibration standards established by a standards organization, with respect to microwave ovens using DC power, are strict compared with those of a microwave oven using AC power for a home use. For example, a vibration standard of a microwave oven using DC power and installed in a car is limited to 3.3 to 4G. Accordingly, if a magnetron filter box used in the conventional microwave oven for a home use is applied to the microwave oven for a car, welding portions of choke coils may be easily damaged as the installation structure of the choke coils in the magnetron filter box is too weak to endure significant vibrations.

Therefore, there is a need for a microwave oven usable with DC power which satisfies the vibration standards as well as noise standards with respect to a magnetron filter box used in the microwave oven.

SUMMARY OF THE INVENTION

Accordingly, it is an object of the present invention to provide a microwave oven having choke coils which are installed inside and outside of a magnetron filter box so as to endure strong vibrations and eliminate noise to desired noise standards.

Additional objects and advantages of the invention will be set forth in part in the description which follows, and in part, will be obvious from the description, or may be learned by practice of the invention.

To achieve the above and other objects of the present invention, there is provided a microwave oven comprising a magnetron filter box having a magnetron, at least one first choke coil, and a feed-through condenser installed therein, and at least one second choke coil arranged outside the magnetron filter box and connected in series to the first choke coil, wherein the second choke coil, together with the feed-through condenser, constitutes a low pass filter.

According to an aspect of the present invention, the first choke coil is set to have an inductance smaller than that of the second choke coil.

According to another aspect the present invention, the first and second choke coils comprise corresponding first and second ferrite cores inserted therein, wherein weights of the first and second ferrite cores are proportional to the inductances of the first and second choke coils.

According to still another aspect of the present invention, the second choke coil is mounted on a printed circuit board connected to the magnetron filter box through a lead wire.

BRIEF DESCRIPTION OF THE DRAWINGS

The above and other objects, features and advantages of the present invention will become more apparent and more readily appreciated by describing in detail a preferred embodiment thereof with reference to the accompanying drawings, in which.

DETAILED DESCRIPTION OF THE PREFERRED EMBODIMENTS

Figure 1:
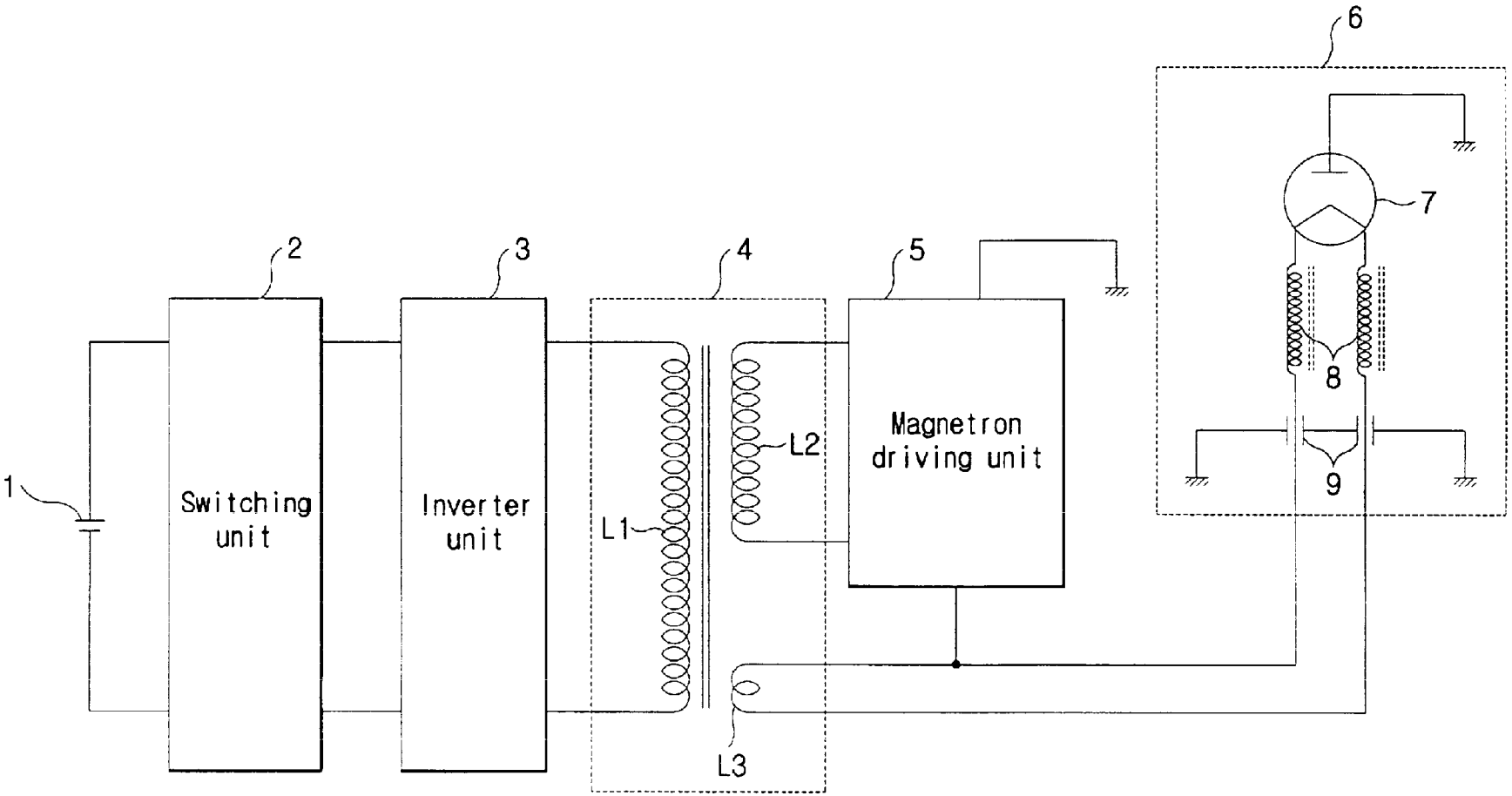
FIG. 1 (PRIOR ART)
FIG. 1 is a block diagram of a conventional microwave oven using DC power.

Reference will now be made in detail to the present preferred embodiments of the present invention, examples of which are illustrated in the accompanying drawings, wherein like reference numerals refer to like elements throughout.

The present invention can be applied to microwave ovens using AC power for a home use as well as microwave ovens using DC power as a power source. Furthermore, the present invention can be applied to microwave ovens usable with a power source selected from DC and AC power sources. For convenience and to avoid unnecessary repetition, the present invention as applied to microwave ovens using DC power is described.

Figure 2:
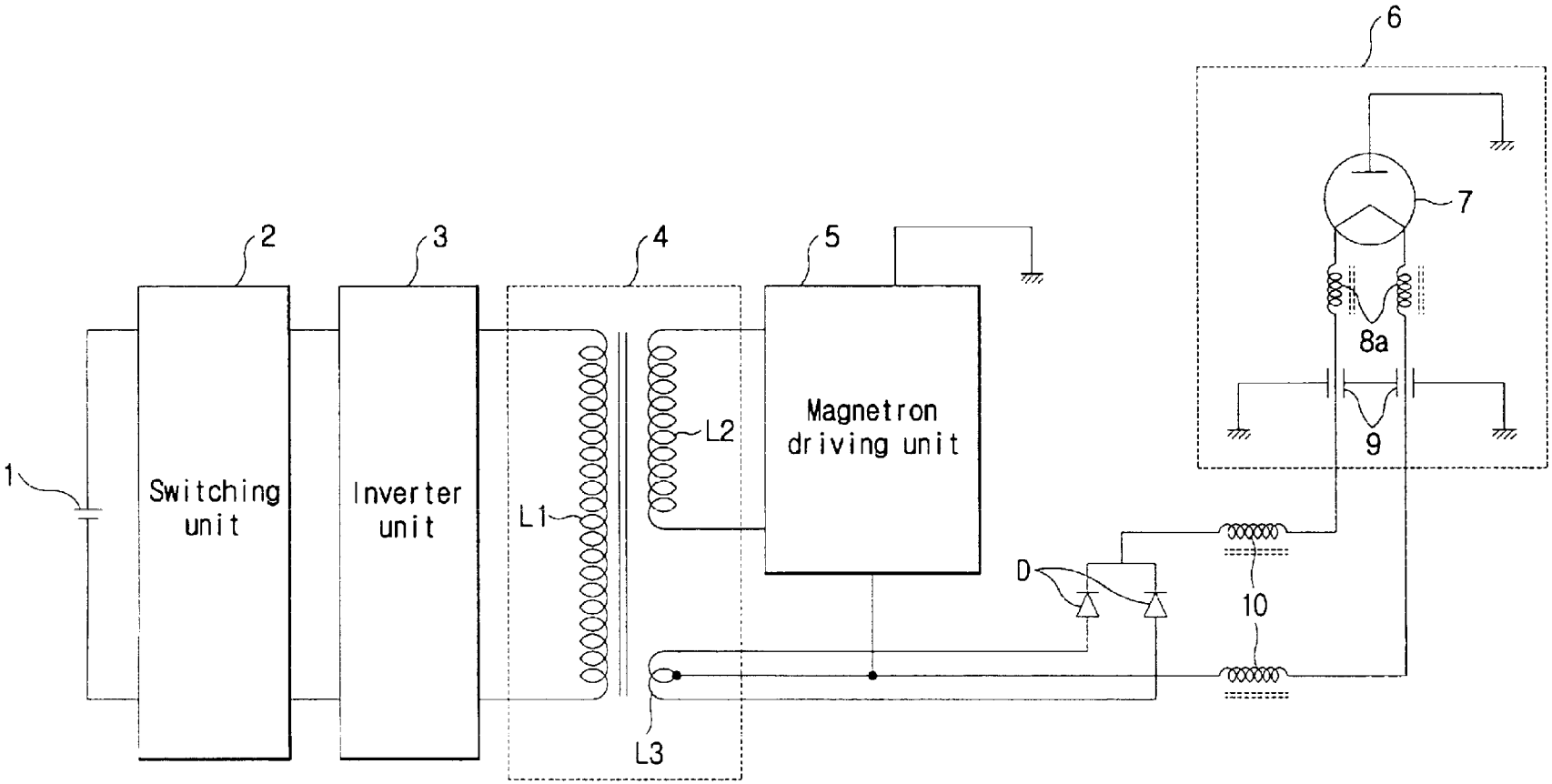
FIG. 2 is a block diagram of a microwave oven using DC power according to an embodiment of the present invention.

FIG. 2 shows a microwave oven using DC power according to an embodiment of the present invention. The microwave oven comprises a DC power source 1, a switching unit 2, an inverter unit 3, a high voltage transformer 4, a magnetron driving unit 5 and a magnetron filter box 6 and second choke coils 10.

The DC power source 1 comprises, for example, a portable battery which supplies DC power of 6 to 48V. The switching unit 2 includes a door switch which detects the open/shut state of a door of a cooking room and blocks the DC power where the door is opened, and a low voltage transformer which supplies operating power to a controller (not shown).

The inverter unit 3 comprises a push-pull circuit having switching devices. The inverter 3 is driven by the controller (not shown) to convert the DC power into AC power, wherein its usable frequency is higher than 20 KHz. The high voltage transformer 4 comprises primary and secondary coils L1 and L2 which induce a high voltage, and a heater coil L3 which heats a magnetron 7.

The magnetron driving unit 5 comprises a half-wave voltage doubler circuit having a high voltage condenser (not shown) and a high voltage diode (not shown). The magnetron driving unit 5 supplies the high voltage of, for example, 4000V DC generated by the secondary coil L2 and the half-wave voltage doubler circuit to the magnetron 7.

The magnetron filter box 6 includes the magnetron 7, first choke coils 8*a* and feed-through condensers 9. The first choke coils 8*a* are connected in series to the second choke coils 10 arranged outside the magnetron filter box 6, respectively.

In addition, rectifying diodes D may be arranged between the heater coil L3 and the second choke coils 10. Similar to the conventional microwave oven using the DC power (FIG. 1), where an operation frequency is high (higher than 20 KHz), it is difficult to drive the magnetron 7 using an AC voltage (3.3V AC) supplied from the heater coil L3. Therefore, in the present invention, DC power (7V DC) rectified by the rectifying diodes D may be supplied to the magnetron 7.

The first choke coils 8*a* are used to eliminate noise. However, their inductances are set to be considerably smaller than the choke coils of the conventional microwave oven. The weight of a ferrite core inserted into each of the first choke coils 8*a* is also reduced in proportion to the reduced inductance. In order to compensate for the reduction of the inductance of each of the first choke coils 8*a*, the inductance of each of the second choke coils 10 is set to be larger than that of each of the first choke coils 8*a*. The inductance of each of the first choke coils 8*a* is set to be as small as possible.

Figure 3:
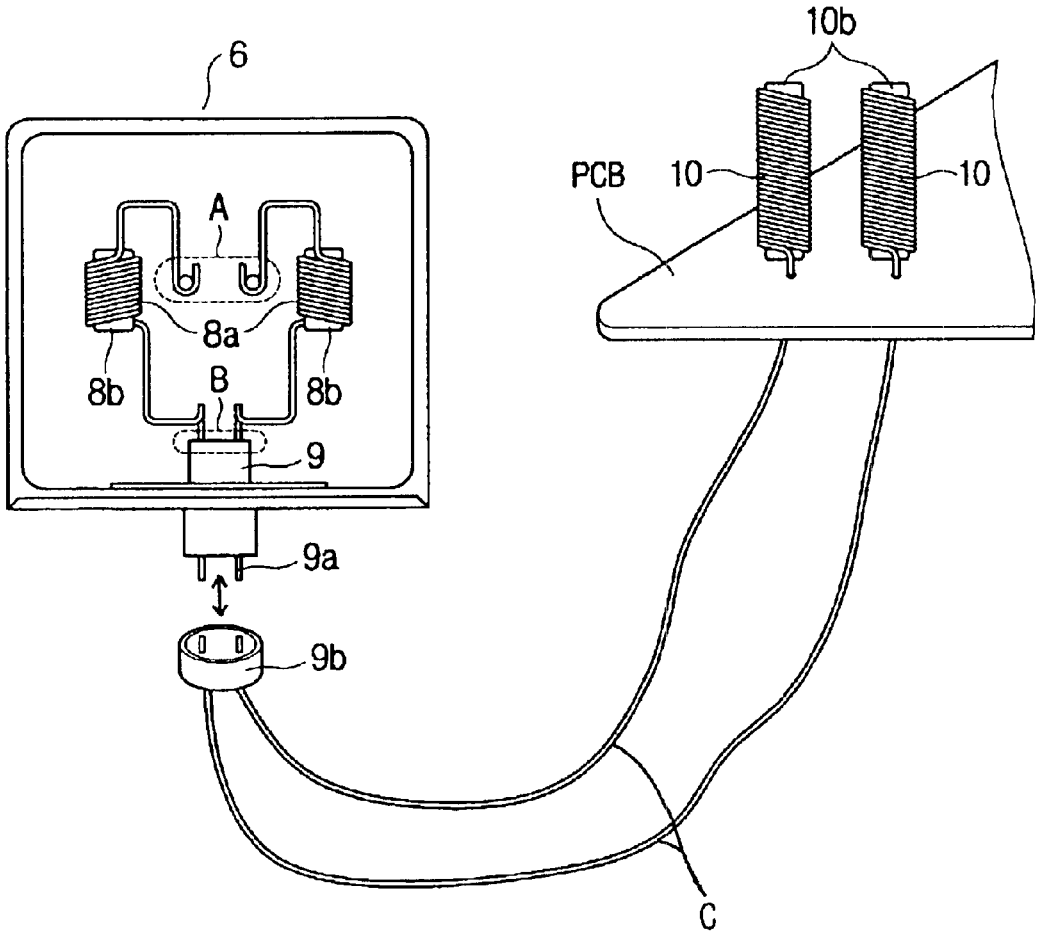
FIG. 3 is a diagram illustrating the installation of second choke coils to first choke coils of the microwave oven shown in FIG. 2.

FIG. 3, with reference to FIG. 2, shows an example of an arrangement and the structure of the first and second choke coils 8*a* and 10. As shown in FIG. 3, ferrite cores 8*b* and 10*b* are inserted into the corresponding first and second choke coils 8*a* and 10. The ends A and B of the first choke coils 8*a* wound around the ferrite cores 8*b* are fixed through a welding process. The second choke coils 10 are mounted on a printed circuit board (PCB) so as to be connected to the first choke coils 8*a* arranged in the magnetron filter box 6 through a socket 9*b* connected to a connection plug 9*a* of the feed-through condenser 9 and leading wires C.

The total inductance of the inductances of the first and second choke coils 8*a* and 10 is set corresponding to frequencies of noise signals to be eliminated, and is set to an inductance value of choke coils used in, for example, a conventional microwave oven using AC power for a home use. The sizes of the first and second choke coils 8*a* and 10 are determined according to their own inductances, wherein their sizes become smaller as their inductances become smaller. Therefore, the first choke coils 8*a* are smaller compared to those of the conventional microwave oven for a home use, while the second choke coils 10 are relatively larger in their sizes.

Because the first choke coils 8*a* are smaller, the ferrite cores 8*b* inserted into the first choke coils 8*a* can also be made to be smaller and lighter. Accordingly, the microwave oven of the present invention can satisfy vibration standards applied to microwave ovens using DC power, and prevent damage to the welded ends A and B of the first choke coils 8*a* in the magnetron filter box 6.

In addition, the first and second choke coils 8*a* and 10 constitute separate low pass filters together with the feed-through condensers 9, and serve to eliminate fundamental waves of 2450 MHz, harmonic waves and noise generated by the driving of the magnetron 7. Therefore, the noise standards required in the microwave ovens using the DC power are also satisfied.

As described above, the present invention provides a microwave oven having first choke coils arranged in a magnetron filter box and second choke coils arranged outside the magnetron filter box. Each choke coil and a feed-through condenser constitute a low pass filter. The first choke coils are designed to be smaller than those in conventional microwave ovens, and the larger second choke coils are fixedly mounted on a PCB. Accordingly, the present microwave oven can endure strong vibrations and eliminate noise generated from a driving of the magnetron according to the noise standards.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A microwave oven comprising:

a magnetron filter box having a magnetron, at least one first choke coil, and a feed-through condenser installed therein; and at least one second choke coil arranged outside the magnetron filter box and connected in series to the first choke coil, wherein the second choke coil, together with the feed-through condenser, constitute a low pass filter.

2. The microwave oven according to claim 1, further comprising a printed circuit board on which the second choke coil is mounted, wherein the second choke coil is connected to the magnetron filter box through a lead wire.

3. The microwave oven according to claim 1, wherein the microwave oven is a microwave oven usable with a power source selected from direct current (DC) and alternating current (AC) power sources.

4. The microwave oven according to claim 1, wherein the first and second choke coils eliminate noise generated by a driving of the magnetron to a desired noise standard and satisfy vibration standards applied to microwave ovens usable with direct current (DC) power as a power source.

5. The microwave oven according to claim 1, wherein the first choke coil comprises an inductance smaller than that of the second choke coil.

6. The microwave oven according to claim 5, wherein the first and second choke coils include corresponding first and second ferrite cores inserted therein, wherein weights of the first and second ferrite cores are proportional to the inductances of the first and second choke coils.

7. The microwave oven according to claim 5, wherein the inductances of the first and second choke coils, as combined, equal to a total inductance which is set according to frequencies of noise signals to be eliminated.

8. The microwave oven according to claim 1, further comprising:

another first choke coil and a second feed-through condenser installed in the magnetron filter box; and another second choke coil arranged outside the magnetron filter box and connected in series to the another first choke coil, wherein the another second choke coil, together with the second feed-through condenser, constitute another low pass filter.

9. The microwave oven according to claim 8, further comprising:

a switching unit which selectively blocks direct current (DC) power;

an inverter unit which converts the DC power to alternating current (AC) power;

a high voltage transformer which induces a high voltage and heats the magnetron; and a magnetron driving unit which supplies the high voltage to the magnetron.

10. The microwave oven according to claim 9, further comprising diodes, each having an anode and a cathode, connected in parallel to the high voltage transformer, wherein the anodes and one of the second choke coils are connected to a heater coil of the high voltage transformer, and the cathodes are connected to the other second choke coil.

11. A microwave oven comprising:

a magnetron filter box having a magnetron, first choke coils and feed-through condensers; and second choke coils arranged outside the magnetron filter box and connected in series to the corresponding first choke coils, wherein the first and second choke coils, together with the feed-through condensers, constitute corresponding low pass filters.

12. The microwave oven according to claim 11, further comprising:

a high voltage transformer which induces a high voltage and includes a heater coil which heats the magnetron; and diodes, each having an anode and a cathode, connected in parallel to the high voltage transformer, wherein the anodes and one of the second choke coils are connected to the heater coil, and the cathodes are connected to another one of the second choke coils.

13. The microwave oven according to claim 11, wherein the first choke coils comprise corresponding inductances smaller than that of the second choke coils.

14. The microwave oven according to claim 11, wherein the first and second choke coils include corresponding first and second ferrite cores inserted therein, wherein weights of the first and second ferrite cores are proportional to the corresponding inductances of the first and second choke coils.

15. The microwave oven according to claim 14, wherein the inductances of the first and second choke coils, as combined, equal to a total inductance which is set according to frequencies of noise signals to be eliminated.

16. The microwave oven according to claim 15, wherein the first and second choke coils eliminate noise generated by a driving of the magnetron to a desired noise standard and satisfy vibration standards applied to microwave ovens usable with the DC power as a power source.

17. The microwave oven according to claim 16, wherein the microwave oven is a microwave oven usable with a power source selected from DC and AC power sources.

18. A microwave oven comprising:

a magnetron filter box having a magnetron and a feed-through condenser; and choke coils which are installed inside and outside of the magnetron filter box so as to eliminate noise generated by a driving of the magnetron and satisfy vibration standards applied to microwave ovens usable with direct current (DC) power as a power source.

19. The microwave oven according to claim 18, wherein the microwave oven is a microwave oven usable with a power source selected from DC and alternating current (AC) power sources.

20. The microwave oven according to claim 18, wherein the choke coil installed outside of the magnetron filter box, together with the feed-through condenser, constitute a low pass filter.

21. The microwave oven according to claim 20, wherein the choke coil installed inside the magnetron filter box comprises an inductance smaller than that of the choke coil installed outside the magnetron filter box.

22. The microwave oven according to claim 21, wherein the choke coils include corresponding ferrite cores inserted therein, wherein weights of the ferrite cores are proportional to the corresponding inductances of the choke coils.

23. The microwave oven according to claim 20, further comprising other choke coils installed inside and outside of the magnetron filter box, wherein the choke coils installed outside the magnetron filter box are in series to the corresponding choke coils installed inside the magnetron filter box.

24. The microwave oven according to claim 23, wherein the choke coils installed inside the magnetron filter box comprise corresponding inductances smaller than that of the choke coils installed outside the magnetron filter box.

25. The microwave oven according to claim 24, wherein the inductances of the choke coils installed inside and outside of the magnetron filter box, as combined, equal to a total inductance which is set according to frequencies of noise signals to be eliminated.

* * * * *